US009510727B2

(12) United States Patent
Classen et al.

(10) Patent No.: US 9,510,727 B2
(45) **Date of Patent: *Dec. 6, 2016**

(54) WATER-CONDUCTING DOMESTIC APPLIANCE COMPRISING A DETERGENT DOSING SYSTEM WITH FILL LEVEL DETECTION

(71) Applicant: BSH HAUSGERÄTE GMBH, Munich (DE)

(72) Inventors: Egbert Classen, Stahnsdorf (DE); Helmut Jerg, Giengen (DE)

(73) Assignee: BSH Hausgeräte GmbH, Munich (DE)

( * ) Notice: Subject to any disclaimer, the term of this patent is extended or adjusted under 35 U.S.C. 154(b) by 499 days.

This patent is subject to a terminal disclaimer.

(21) Appl. No.: 14/031,071

(22) Filed: Sep. 19, 2013

(65) Prior Publication Data

US 2014/0014684 A1 Jan. 16, 2014

Related U.S. Application Data

(62) Division of application No. 12/311,099, filed as application No. PCT/EP2007/058965 on Aug. 29, 2007, now Pat. No. 8,613,805.

(30) Foreign Application Priority Data

Sep. 19, 2006 (DE) ..... 10 2006 043 973

(51) Int. Cl.
*A47L 15/44* (2006.01)
*D06F 39/02* (2006.01)

(52) U.S. Cl.
CPC ..... *A47L 15/449* (2013.01); *A47L 15/4454* (2013.01); *A47L 15/4463* (2013.01); *D06F 39/022* (2013.01)

(58) Field of Classification Search
CPC ..... A47L 15/4454; A47L 15/4463; A47L 15/449; D06F 39/022
See application file for complete search history.

(56) References Cited

U.S. PATENT DOCUMENTS 2,771,892 A 11/1956 St. Palley
3,870,417 A 3/1975 Bashark
(Continued)

FOREIGN PATENT DOCUMENTS

DE 2810216 A1 9/1979
DE 3911862 A1 10/1990
(Continued)

OTHER PUBLICATIONS

International Search Report PCT/EP2007/058965 dated Dec. 5, 2007.

*Primary Examiner* — Alexander Markoff
(74) *Attorney, Agent, or Firm* — Michael E. Tschupp; Andre Pallapies

(57) ABSTRACT

A water-conducting domestic appliance, in particular a domestic dishwasher, the water-conducting domestic appliance including a washing compartment for receiving items therein that are to be subjected to a washing cycle by the water-conducting domestic appliance; and a detergent dosing system, the detergent dosing system having a detergent dispenser with a receiving compartment, the receiving area for receiving at least one cartridge that is configured to hold at least one detergent, the detergent dosing system having the capability to store a quantity of detergent greater than a quantity needed for a single washing cycle and the detergent dosing system having an apparatus for detecting a fill level in at least one of the detergent dispenser and the at least one cartridge.

14 Claims, 5 Drawing Sheets

(56) References Cited

U.S. PATENT DOCUMENTS

| | | | | |
|---|---|---|---|---|
| 4,063,457 | A | 12/1977 | Zekulin et al. | |
| 4,656,384 | A | 4/1987 | Magori | |
| 5,378,993 | A | 1/1995 | Flask et al. | |
| 5,686,987 | A | 11/1997 | Hewitt et al. | |
| 5,969,621 | A | 10/1999 | Getman et al. | |
| 6,323,584 | B1 | 11/2001 | Brown | |
| 8,381,744 | B2 * | 2/2013 | Classen | 134/100.1 |
| 8,382,913 | B2 * | 2/2013 | Classen | A47L 15/4454 134/25.2 |
| 8,484,999 | B2 * | 7/2013 | Classen | 134/56 D |
| 8,613,805 | B2 * | 12/2013 | Classen | A47L 15/4454 134/18 |
| 8,696,828 | B2 * | 4/2014 | Classen | 134/18 |
| 8,980,014 | B2 * | 3/2015 | Classen | A47L 15/4463 134/18 |
| 2002/0088502 | A1 | 7/2002 | Van Rompuy et al. | |
| 2007/0144558 | A1 | 6/2007 | Classen et al. | |
| 2007/0181155 | A1 | 8/2007 | Curtius et al. | |
| 2007/0272286 | A1 | 11/2007 | Curtius et al. | |

FOREIGN PATENT DOCUMENTS

| | | | |
|---|---|---|---|
| DE | 10341542 | A1 | 4/2005 |
| EP | 0392196 | B1 | 2/1994 |
| WO | 0229150 | A2 | 4/2002 |
| WO | 02058528 | A1 | 8/2002 |
| WO | 2006073885 | A2 | 7/2006 |

* cited by examiner

WATER-CONDUCTING DOMESTIC APPLIANCE COMPRISING A DETERGENT DOSING SYSTEM WITH FILL LEVEL DETECTION

CROSS-REFERENCE OF RELATED APPLICATIONS

This application is a Divisional, under 35 U.S.C. §121, of U.S. application Ser. No. 12/311,099, filed Mar. 18, 2009, which is a U.S. national stage application of PCT/EP2007/058965 filed Aug. 29, 2007, which designated the United States; this application also claims the priority, under 35 U.S.C. §119, of German patent application No. 10 2006 043 973.2 filed Sep. 18, 2009.

BACKGROUND OF THE INVENTION

The majority of domestic dishwashers currently in use have an adding device for holding one or more detergents, which are added to the wash liquor during the course of a wash cycle to clean the items to be washed that have been arranged in the dishwasher. Conventionally the detergent held in the adding device is discharged in its entirety into the wash compartment during the wash cycle and mixed in with the wash liquor circulating therein. In terms of its size the adding device is dimensioned so that the precise quantity of detergents required for a wash cycle can be introduced. The user of the dishwasher is therefore obliged to introduce the quantity of detergent required for the wash cycle into the adding device at the start of each wash cycle. This operation is inconvenient for the dishwasher user. There is also the problem with such dishwashers that the quantity of detergents introduced into the adding device can vary from user to user and from wash operation to wash operation. An incorrectly dosed quantity of detergent can result on the one hand in unsatisfactory wash results if too little detergent has been dosed and on other hand can result in a waste of detergents and an environmental burden, if too large a quantity of detergents has been dosed.

Adding devices which add the quantity of detergent stored therein to the wash liquor in one go also do not permit the execution of more complex wash programs. Thus for example in certain situations it can be expedient to add the detergent to the wash liquor at different times. Adding devices that are configured to hold a single dose of detergent cannot support such complex wash cycles.

With detergent dosing systems, in which a number of detergents are stored in different compartments of a cartridge or storage containers, the problem arises that when the addition of the detergent is controlled by sensor—depending on the degree of soiling of the wash liquor—the detergents can be used up at different times. In particular with cartridges, in which the chambers are arranged in a common housing of the cartridge, this can require a change of cartridge when some of the detergents have not yet been used up. This waste of detergents results in an environmental burden when the cartridge is disposed of by way of the garbage system for example.

BRIEF SUMMARY OF THE INVENTION

It is therefore the object of the present invention to specify a water-conducting domestic appliance which allows a predetermined fill level of detergents in a cartridge to be signaled in a structurally simple manner. It is also the object of the invention to provide a corresponding detergent dosing system.

This object is achieved by a water-conducting domestic appliance with the features of claim 1.

A water-conducting domestic appliance, in particular a domestic dishwasher, has a detergent dosing system, the detergent dosing system having a detergent dispenser with a receiving compartment for receiving at least one cartridge, the cartridge being configured to hold at least one detergent. The invention is characterized in that the quantity of detergent held is greater than the quantity required for a wash cycle and the detergent dosing system has an apparatus for detecting a fill level in the detergent dispenser and/or at least one cartridge.

The detergent dosing system for dishwashers can be configured to be arranged in particular adjacent to a wash compartment of the dishwasher in the interior of the dishwasher. The detergent dosing system contains detergent, the quantity of detergent held being greater than the quantity required for a wash cycle. The detergent dosing system essentially supplies precisely the quantity of detergent required for a wash cycle. Detergents can be combinations of cleaning components or individual cleaning substances, e.g. an enzyme. The detergents can be liquids or gels. The detergent dosing system can be configured to emit a signal when a fill level, for example a predetermined fill level, is detected. According to a first variant the detergent dosing system has a number of separate chambers for holding the respective detergents. The apparatus for detecting the predetermined fill level is configured to determine the fill level of at least one but not all the chambers.

According to a further variant of the inventive detergent dosing system the detergent dosing system for dishwashers also comprises a second detection means for detecting the dosing operations carried out since insertion of the full cartridge and an evaluation means which determines the fill level of the detergent in the detergent dosing system from the information from the second detection means at least.

To signal a predetermined fill level—of all the detergent contained in the cartridge—the inventive detergent dosing system according to the first and second variants uses an indirect procedure. According to the first variant not all the chambers of the detergent dosing system are monitored in respect of their fill levels but monitoring only takes place in some of the chambers. This determined information can be used to draw conclusions about the overall fill level of detergent on the detergent dosing system.

With the detergent dosing system there is no direct measurement of the fill level of the detergent in the detergent dosing system; instead the dosing operations carried out since the insertion of a full cartridge are monitored and the information determined and stored during the dosing operations is used to draw conclusions about the fill level.

According to one embodiment the apparatus for detecting the predetermined fill level is configured to detect the fill level of just one chamber. This procedure ensures an economical and cost-effective structure.

According to a further embodiment the detergent dosing system has a detergent dispenser with a receiving compartment for receiving at least one cartridge containing the detergents and the apparatus for detecting the predetermined fill level is configured in the detergent dispenser and/or the cartridge.

According to a further embodiment the apparatus for detecting the predetermined fill level operates according to an optical principle. To this end the apparatus for detecting a fill level has a light emitter, a light receiver and a optical waveguide, it being possible for light beams emitted by the light emitter to be coupled into the optical waveguide and for light beams leaving the optical waveguide to be taken up by the light receiver, it being possible to verify by evaluating the coupled and decoupled light beams whether the predetermined fill level has been reached. The evaluation is based on a comparison of the coupled and decoupled light beams.

According to a further embodiment the optical waveguide has a first coupling surface and a second coupling surface, it being possible for light beams from the light emitter to be coupled in by the first coupling surface and the light beams leaving the optical waveguide to be decoupled by the first or second coupling surface. If the light beams leaving the optical waveguide are decoupled by the first coupling surface, the light emitter and light receiver can be configured as a structural unit. The optical waveguide can be configured as a bar for example, utilizing the reflection properties of the optical waveguide. If the light beams leaving the optical waveguide are decoupled by the second coupling surface, the light emitter and light receiver are configured separately from one another. The optical waveguide can be configured as a helix for example, which deflects the light beams. In both instances the different refraction properties are utilized when the optical waveguide is surrounded by detergents compared with a situation where the optical waveguide is not or is only partly surrounded by detergents.

According to a further embodiment the light emitter and light receiver are arranged in the detergent dispenser. The optical waveguide is arranged in the cartridge in which the detergent is located. When the cartridge is inserted in the detergent dispenser, the light emitter or light receiver and optical waveguide are arranged in relation to one another such that the light coupling and decoupling described above can take place. A mechanism is preferably provided here to ensure that the cartridge can only be inserted into the detergent dispenser one way, so that the function of the detection apparatus can be ensured. This can be ensured for example by mechanical coding on the cartridge, e.g. a projection, and a corresponding recess on the detergent dispenser, and vice versa.

According to another variant the apparatus for detecting a fill level operates according to a capacitive principle. The apparatus for detecting the predetermined fill level has a first and second electrode with a dielectric arranged between the first and second electrodes, the first electrode being formed by the detergent and the second electrode being arranged in the detergent dosing system so that it is electrically insulated from the first electrode and the predetermined fill level being established by evaluating the voltage present between the first and second electrodes. The second electrode is formed from an electrically conducting material and can be arranged on the outer wall of the cartridge or a housing wall of the detergent dispenser. The dielectric between the first and second electrodes is formed by the wall of the cartridge and/or the wall of the detergent dispenser and/or in some instances an air gap. This depends essentially on the arrangement of the second electrode. As the fill level of detergent in the cartridge drops, the capacitance of the capacitor formed by the first and second electrodes changes, it being possible to evaluate this without further ado based on the voltage present between the first and second electrodes. This data allows conclusions to be drawn about the fill level of detergent in the cartridge.

In both described variants it is possible to set the fill level, at which the signal is to be emitted, by the length the optical waveguide extends in the cartridge in the direction of gravity or the length the second electrode extends in the direction of gravity. It is thus advantageously possible to set whether a signal is to be emitted when the cartridge is completely empty or at a time when a number m, preferably between 2 and 5, dosing operations are still contained in the detergent dosing system.

According to a further variant the apparatus for detecting the predetermined fill level operates according to an acoustic principle. To this end the apparatus for detecting a fill level has an excitation means, which can be used to cause the detergent to oscillate, and an evaluation means, which can be used to evaluate the resulting noise pattern. A generator operating according to the piezo ultrasound principle can preferably be used as the excitation means here.

In the detergent dosing system embodied according to the second variant the second detection means according to one embodiment detects the number of dosing operations and/or the volume removed respectively from the detergent dosing system. These parameters allow precise determination of the fill level. A permanent comparison of a predetermined fill level with the calculated fill level allows a decision to be taken whether the signal should be emitted to signal to the user that the cartridge needs to be replaced or will shortly need to be replaced.

To identify a new or full cartridge automatically the detergent dosing system according to the second variant is provided in one embodiment with a transponder, it being possible for the first detection means to read out the information stored in the transponder for further evaluation. Alternatively the cartridge can be provided with a code, in particular a bar code, to identify the new or full cartridge, it being possible for the first detection means to read out the information stored in the transponder for further evaluation. In the first instance the first detection means has a receive apparatus, which can read out the information stored in the transponder as it approaches the receive facility. The system here can operate in a passive manner, in other words the transponder attached to the cartridge does not require its own energy supply. The energy required for reading out is supplied to the transponder by the receive facility, as soon as it is in its operating range.

To this end the first detection means can have a bar code reader, which is arranged in the detergent dosing system, so that the information contained in the bar code is read out automatically as soon as the cartridge is inserted into the detergent dosing system. However the bar code reader can also be arranged on another module of a dishwasher, so that the user for example has to pass the cartridge in front of the bar code reader before inserting the cartridge into the detergent dosing system.

A structurally particularly simple design of the apparatus for detecting a predetermined fill level of detergent results if the volume of detergents held in the number of chambers is dimensioned so that a total of z wash cycles can be carried out and each of the detergents is used up after the zth wash cycle. This procedure ensures that the cartridge contains no detergent when it is replaced. This state is achieved in particular if, according to one development of the invention, an identical percentage of the at least two detergents is dosed by the dosing system in each wash operation. Provision can be made here for the total number z of wash cycles to be variable for the consumption of a number of cartridges and to be a function of the respective wash cycles carried out. This variant ensures that, regardless of the number of chambers holding detergent, a single apparatus for detecting the fill level (of one of the chambers) is sufficient to provide reliable information about an empty cartridge or about the number of dosing operations that can still be carried out.

The invention also includes a detergent dosing system of the type described above.

BRIEF DESCRIPTION OF THE DRAWINGS

The invention is described in more detail below with reference to the figures, in which.

DETAILED DESCRIPTION OF EXEMPLARY EMBODIMENTS OF THE PRESENT INVENTION

Figure 1:
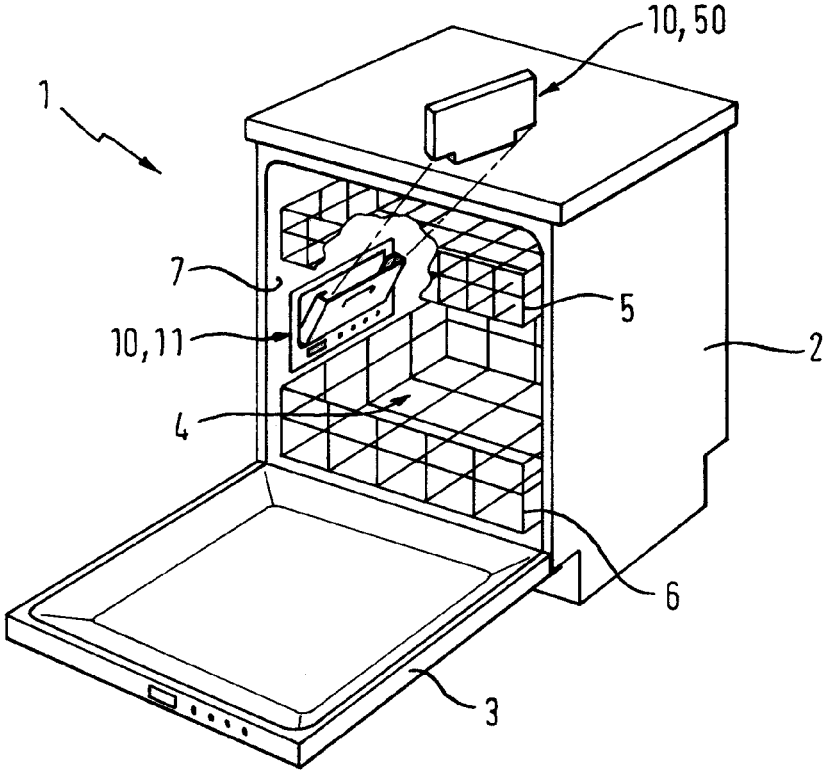
FIG. 1 shows a dishwasher with a detergent dosing system for receiving a cartridge, which is arranged in a container wall.

FIG. 1 shows a dishwasher 1, which has a door 3 supported in a pivotable manner on a housing 2. In the figure the door 3 is shown in its open position. Racks 5, 6 are arranged in the known manner in a wash compartment 4 that can be closed off by the door 3. A detergent dosing system 10, comprising a detergent dispenser 11 and an inventive cartridge 50, which contains at least two detergents held separately from one another, is arranged in a container wall 7 of the housing 2. FIG. 1 shows the preferred arrangement here for a detergent dosing system 10 between the upper rack 5 and lower rack 6. The detergent dispenser 11 holding the cartridge 50 is arranged here in a segment of the container wall 7 in proximity to the door opening, to facilitate the insertion and removal of the cartridge 50 into or out from the detergent dispenser 11 for the user.

The detergent dispenser 11 comprises a housing 12 and a cover supported in such a manner that it can be pivoted in relation to the housing 12. When the cover is in its open position (see diagram in FIG. 1), the cartridge 50 can be inserted into the cover from the wash compartment 4. For holding and fixing purposes the cover has for example two symmetrically arranged retaining clips, having an L shape and being matched to the size of the cartridge 50, so that the retaining clips engage around the cartridge 50 in a retaining manner after insertion (not shown). A bearing surface is also molded on the cover, so that the cartridge 50 comes to rest in a defined position. Closing the cover causes the cartridge to be introduced into a receiving compartment of the detergent dispenser 11, it being pushed into its final position by lugs and/or projections that are optionally present on the housing of the detergent dispenser.

Figure 2:
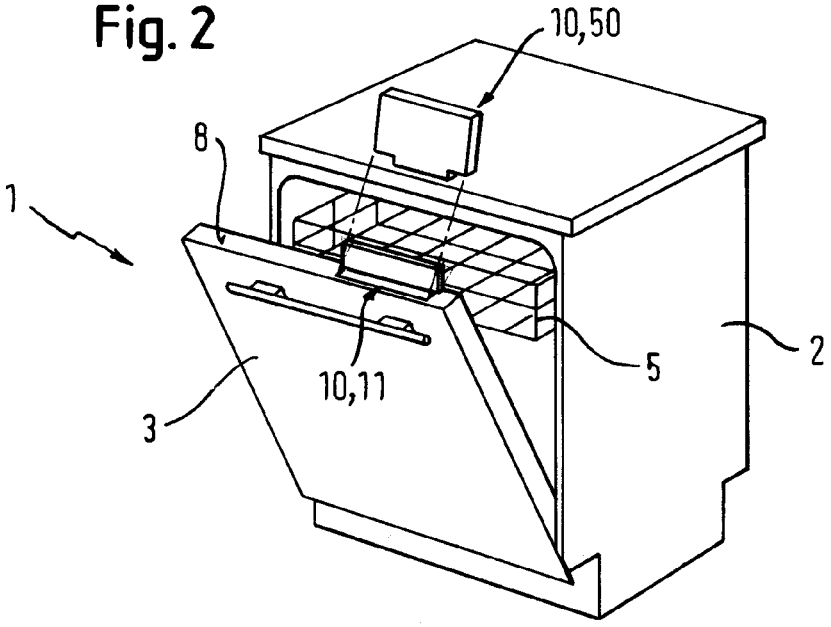
FIG. 2 shows a further dishwasher with a detergent dosing system for receiving a cartridge, which is arranged in the door of the dishwasher.

FIG. 2 shows a further dishwasher 1 with a detergent dosing system 10. In contrast to the exemplary embodiment described above, the detergent dosing system 10, or more specifically the detergent dispenser 11, is arranged in the door 3 of the dishwasher. The cartridge 50 is inserted into the detergent dispenser 11 from the front 8 of the door. The opening for insertion into the detergent dispenser 11 can be arranged in the region of a front panel of the dishwasher or the inner door of the door here. The advantage of the arrangement according to FIG. 2 is that it is easier for the user to insert and remove the cartridge.

Figure 3:
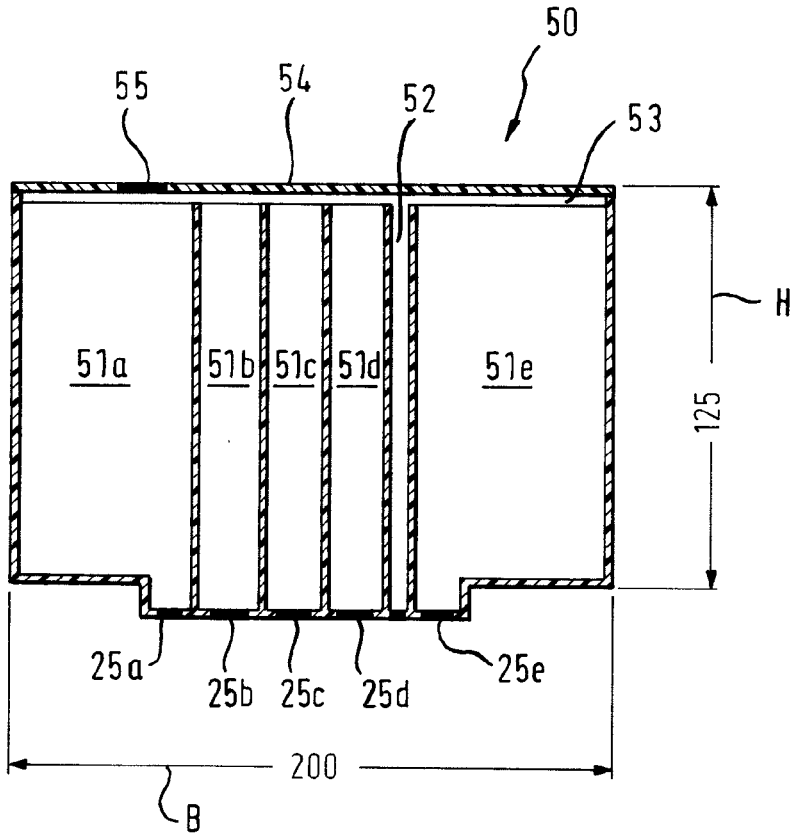
FIG. 3 shows a section through a cartridge holding detergent.

An exemplary embodiment of the cartridge 50 is shown in FIG. 3. The cartridge 50 has five chambers 51*a*, 51*b*, 51*c*, 51*d* and 51*e* purely by way of example, respectively receiving one detergent or detergent mixture. The size of the individual compartments 51*a* to 51*e* here is dimensioned according to the volume required for a predetermined number of dosing operations. The volume of the different detergents is dimensioned in the chambers 51*a* to 51*e* such that after a certain number of dosing operations, preferably between 20 and 40, even more preferably around 30, all the chambers 51*a* to 51*e* are emptied at the same time and essentially completely.

The total number of dosing operations to empty the cartridge is a function of the type of wash cycles carried out in each instance. To meet the various requirements, a specific dosing quantity is predetermined or determined by sensor for each program that can be selected in the dishwasher. A smaller dosing quantity is selected for lightly soiled items to be washed, while a larger dosing quantity of detergents is provided for heavily soiled items to be washed. It will be understood by those skilled in the art that the present dishwasher includes a preprogrammed controller for carrying out washing programs, in operative communication with the detergent dosing system to control functions thereof, including dosing operations, evaluation of signals from the detection means and signals emitted for user information. Such a preprogrammed controller, insofar as it controls detergent dosing system operations, can be considered part of the detergent dosing system.

To ensure that each of the detergents is used up in the same wash cycle, the percentage of each detergent component added to the wash liquor during a dosing operation is identical. This allows economies to be made with available resources, as a cartridge is only replaced when it is completely empty.

To ensure that the same volume is added to the wash liquor regardless of the fill level of the respective detergent in the cartridge, the run-out time taken for the detergent to exit from the cartridge for further processing when the openable closing means is opened is varied as a function of the number of dosing operations carried out since insertion of the new, full cartridge. The run-out time for the detergents is determined according to the formula $$t_n = x + (n-1) \cdot y,$$

where t is the run-out time of the detergent(s), n is the number of the dosing operation, x is the run-out time of the detergent(s) in the first dosing operation, and y is a constant.

As the number of wash operations increases, the run-out time of the detergent(s) is thus extended, so that the decrease in pressure as the volume of detergent in the cartridge decreases is taken into account.

The detergent can be transported solely by gravity here. The transportation facility, in particular the configuration of the seal, can however also be structured according to the principle of a pump, so that detergent is transported from the cleaning chamber into the dosing chamber and from the dosing chamber into the wash compartment.

Each of the chambers 51*a* to 51*e* is provided with an openable closing means 25*a* to 25*e*, e.g. in the form of a membrane. The membranes, which are made of rubber for example, seal the individual chambers 51*a* to 51*e* off so that no detergent can escape during storage and transportation of the cartridge 50. When the cartridge 50 is inserted into the detergent dispenser 11 the membranes are pierced by cannulas 21 arranged correspondingly in the detergent dispenser 11 so that detergent can be dispensed into the wash compartment in keeping with a corresponding dosing apparatus.

The cartridge is preferably made of a plastic material and has a width B of approximately 200 mm, a height H of approximately 125 mm and a depth of approximately 25 mm. These dimensions allow the volume of the different chambers to be dimensioned so that the desired 20 to 40 wash cycles can be carried out using one cartridge.

In addition to the chambers 51*a* to 51*e* the cartridge 50 has a further chamber 52, which is connected to one or more ventilating channels 53. The ventilating channel(s) 52 is/are connected in turn to the different chambers 51*a* to 51*e*. This ensures that as the chambers 51*a* to 51*e* become increasingly empty, a negative pressure cannot build up therein, which would impede or falsify the adding of detergents. The ventilating channels 53 are preferably located in a cover 54, which is placed on top of the housing of the cartridge after the individual chambers 51*a* to 51*e* have been filled with the respective detergents. The cover 54 can have an overpressure valve 55, which may be necessary for certain detergent components.

To detect an empty or almost empty cartridge the detergent dosing system has means for querying the fill level of detergents in the cartridge. When the detergents in one or more of the chambers in the cartridge reach a predetermined fill level, e.g. when a predetermined number of wash cycles is still possible, this can be indicated to the user by way of an optical signal. The display apparatus can be located in the known manner, e.g. on the outside of the door, e.g. of the panel.

Figure 4:
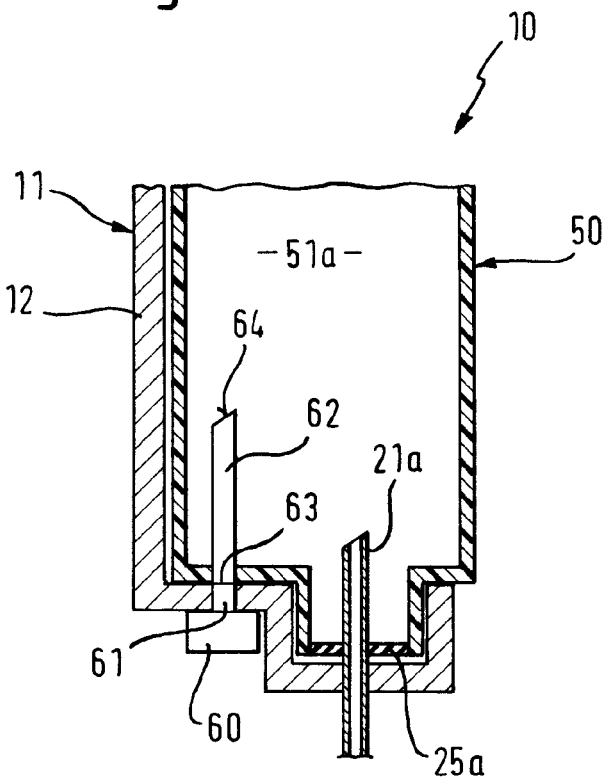
FIG. 4 shows a first exemplary embodiment of an apparatus for detecting a predetermined fill level of detergent in the cartridge.
Figure 5:
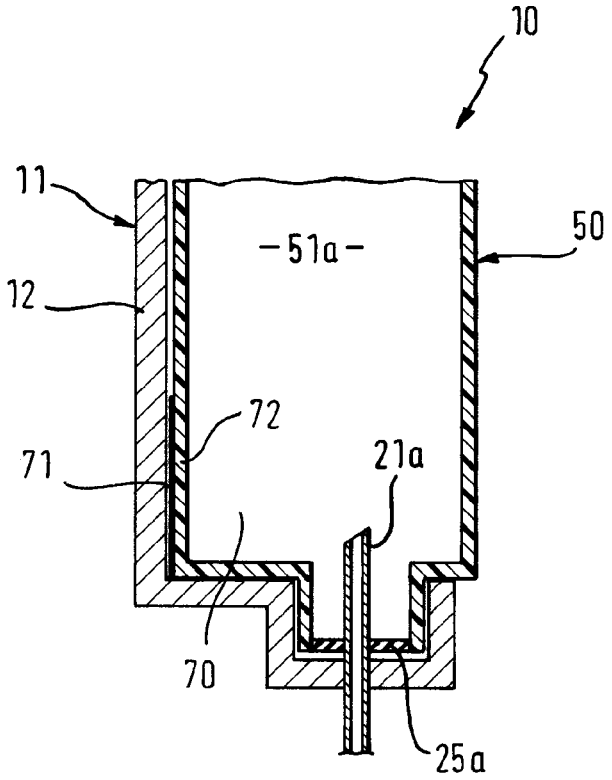
FIG. 5 shows a second exemplary embodiment of an apparatus for detecting a predetermined fill level of detergent in the cartridge.
Figure 6:
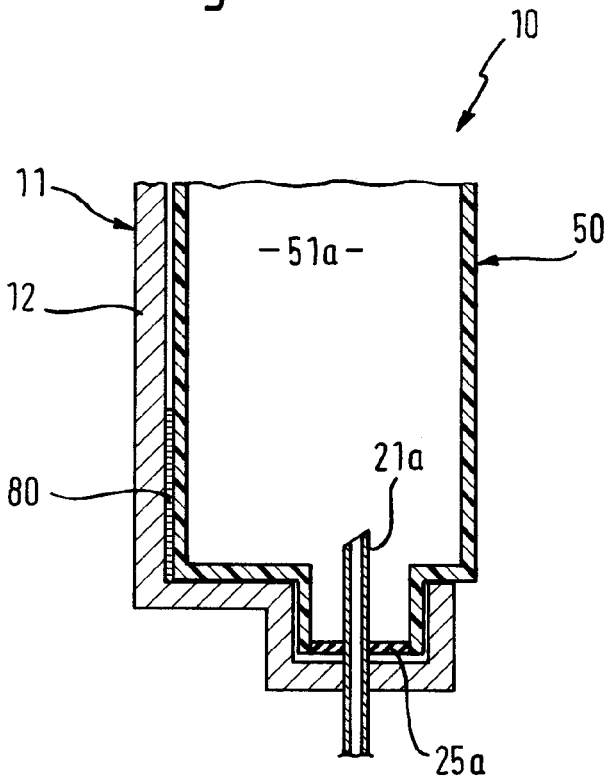
FIG. 6 shows a third exemplary embodiment of an apparatus for detecting a predetermined fill level of detergent in the cartridge.

FIGS. 4 to 6 show different exemplary embodiments of how it is possible to determine a predetermined fill level of the cartridge. The method for dosing the detergents held in different compartments described above allows the fill level to be sensed in just one of the chambers in the cartridge to provide information about the fill level of the cartridge as a whole. In principle it is possible to provide the apparatuses for detecting a specific fill level described below in any number of the chambers in the cartridge, in so far as the apparatus for determining the fill level does not provide general information about the fill level of detergent.

In the exemplary embodiment according to FIG. 4 the fill level is detected using an optical principle. A section of the detergent dosing system 10 is shown in cross section. The cartridge 50 is located in a receiving compartment of the detergent dosing system formed by the detergent dispenser 11. The form of the housing of the cartridge 50 is matched here to the shape of the housing 12 of the detergent dispenser 11. The cannula 21*a* of the chamber 51*a* arranged at the base of a housing step of the housing 12 pierces the openable closing means 25*a* of the cartridge 50 and projects into the chamber 51*a*. In contrast to the diagram the end of the cannula 21*a* projecting into the chamber 51*a* is arranged as close as possible to the base of the cartridge 50, to prevent detergent residues remaining in the cartridge.

A predetermined detergent fill level is detected using an emit/receive unit 60, which is arranged on the base of the housing 12 of the detergent dispenser 11. A light-guiding element 61, for example a lens, lies flush with the base of the housing 12. An optical waveguide 62, made of plastic or glass for example, is secured in the base of the housing of the cartridge 50 to correspond to the light-guiding element 61. When the cartridge 50 is inserted in the detergent dispenser 11, as shown in FIG. 4, a first coupling surface 63 of the optical waveguide 62 (which lies flush with the base of the housing of the cartridge 50) lies adjacent to the light-guiding element 61. Light emitted from the emit/receive unit 60 can thus be coupled into the optical waveguide 62. In the exemplary embodiment the light beams coupled in are reflected at a second coupling surface 64 of the optical waveguide 62 and fed back to the light receiver by way of the coupling surface 63. By evaluating, in particular comparing, the coupled and decoupled light beams it can be established whether the second coupling surface 64 lies within the detergent or outside it. These two instances produce different refraction properties at the second coupling surface 64, which can be detected without further ado by an evaluation unit.

With a corresponding configuration of the optical waveguide 62, e.g. a curve in the form of an inverted U or a helix, the light beams emitted from the light emitter can be coupled in at a first coupling surface and decoupled at a second coupling surface of the optical waveguide. In this variant the second coupling surface is likewise configured in the base of the cartridge 50.

It can be established from the length or height, by which the optical waveguide 62 projects upward in the direction of gravity into the cartridge 50, at which fill level or volume of detergent a signal should be emitted.

In the exemplary embodiment according to FIG. 5 a predetermined fill level is detected using a capacitive principle. A first electrode 70 is formed by the detergent held in the chamber 51*a* using a conducting conductor at the cannula 21*a* disposed within the detergent. The detergent then acts as an electrolyte. A second electrode 71, which is formed by an electrically conducting material, is arranged for example on the outer wall of the housing of the cartridge 50 or the wall of the detergent dispenser 11 facing toward the cartridge. The housing wall 72 of the cartridge 50 between the first and second electrodes 70, 71 forms a dielectric of the capacitor. As indicated above, electrical contacting of the first electrode formed by the detergent can be effected for example by a conducting conductor at the cannula 21*a*. The fill level is detected by evaluating the voltage present between the first and second electrodes 70, 71, which varies depending on the fill level in the chamber 51*a*. The variation results from the degree of overlap of the detergent with the second electrode 71 of the capacitor. By comparing the measured voltage with a predetermined voltage it is possible to detect that the level is below a predetermined fill level. The second electrode 71 can extend over the entire width of the chamber 51*a* or over the entire width of the cartridge and to any height of the cartridge. It is possible to establish from the height upward in the direction of gravity in particular when it should be possible to detect a change in voltage for the first time. It is thus possible to set the emission of a signal for a predetermined fill level using the height of the second electrode.

In the exemplary embodiment according to FIG. 6 the fill level in the chamber 51*a* is detected based on an acoustic principle. To this end the detergent dosing system 10 is provided with an excitation means 80, e.g. a piezo ultrasound generator, which is arranged on the detergent dispenser 11 in such a manner that it can cause the detergent in the cartridge 50 to oscillate. The resulting noise can be detected and evaluated by an evaluation means, which is arranged outside the receiving compartment of the cartridge 50 for example. It is possible to draw conclusions about the fill level of detergent in the cartridge in a simple manner based on the noise spectrum. The emission of a signal at a predetermined fill level can be initiated by comparing the measured spectrum with a stored spectrum.

A further apparatus for monitoring the fill level of detergent in the cartridge, which is not shown in the figures, uses indirect determination, in that the dishwasher has a detection means for identifying a full cartridge, e.g. a transmit/receive apparatus of a transponder system or a bar code, and a detection means for detecting the dosing operations carried out since insertion of the full cartridge. The latter preferably detects the number of dosing operations and the volume of detergent removed respectively from the detergent dosing system. From this information it is possible to determine the absolute fill level of detergent in the detergent dosing system in a simple manner.

Since the detergents contained in the cartridge 50 are only added to the wash compartment, more specifically to the wash liquor circulating in the wash compartment, gradually over a number of wash cycles, they are exposed to considerable absolute temperatures and temperature fluctuations with each wash cycle. To prevent the properties of the detergents changing as a result of these over time, at least one housing wall of the cartridge 50 facing the wash compartment and/or cover of the detergent dosing system 10 facing the wash compartment is/are made of an insulating material or surrounded by insulation. This limits the flow of heat from the wash compartment in the direction of the detergent dosing system or the detergents held in the cartridge, so that the long-term stability of the detergents used is ensured. The insulation can be formed by a volume of gas arranged in the cover or the relevant housing segment of the cartridge. This volume of gas producing the insulation can be inserted during manufacture of the cover or cartridge. The method used for this is known as the gas internal pressure process (GID).

As well as the receiver for the cartridge the detergent dispenser 11 can have a further chamber for receiving a solid detergent. The solid detergent can be a 3-in-1 tablet for example, which is inserted into the further chamber when there is no cartridge or an empty cartridge 50 in the receiving compartment. Provision of the further chamber for receiving a solid detergent means that the dishwasher can also be used when the cartridge 50 is empty and there are no full cartridges to hand.

The further chamber can have an opening, which is connected to the surrounding area of the dishwasher. To this end the opening can be connected to the surrounding area by way of channels along the rear face of the container wall. The detergent dosing system then integrates the function of a so-called expansion opening, which serves to duct away the overpressure occurring in the wash compartment when the dishwasher containing already heated water is opened and closed again by the user, for example during a wash cycle. The overpressure occurring at that time can then be ducted away to the surrounding area by way of the further chamber and the opening.

What is claimed is:

1. A detergent dosing system for a water-conducting domestic appliance, the detergent dosing system comprising:

a detergent dispenser with a receiving compartment for receiving a plurality of cartridges, each of the cartridges being configured to hold at least one detergent, the detergent dosing system being configured for storing a quantity of detergent greater than a quantity needed for a single washing cycle; and an apparatus for detecting a fill level in at least one of the detergent dispenser and at least one cartridge of the plurality of cartridges, the apparatus for detecting a fill level being configured to detect a fill level of at least one cartridge wherein the detergent dosing system is configured to determine and control a run-out time of detergent exiting a cartridge during each dosing operation as a function of the number of dosing operations since introduction of a new cartridge and extend the run-out time as the number of dosing operations increases to compensate for decreased pressure in the cartridge as the volume of detergent in the cartridge is expended to dispense the same volume of detergent regardless of the fill level in the cartridge.

2. The detergent dosing system according to claim 1 wherein the apparatus for detecting the fill level is configured to detect a fill level of a single chamber.

3. The detergent dosing system according to claim 1 and further comprising an assembly for optical fill level detection.

4. The detergent dosing system according to claim 3 wherein the assembly for optical fill level detection includes a light emitter, a light receiver and a light-guiding element having a first coupling surface and a second coupling surface and light beams from the light emitter can be coupled in through the first coupling surface and the light beams leaving the light-guiding element can be decoupled through the first or second coupling surface.

5. The detergent dosing system according to claim 3 wherein a light emitter and a light receiver are disposed in the detergent dispenser and a light-guiding element is disposed in a selected one of the plurality of cartridges.

6. The detergent dosing system according to claim 1 wherein the apparatus for detecting a fill level in at least one of the detergent dispenser and at least one cartridge is configured for capacitive detection of a fill level.

7. The detergent dosing system according to claim 6 wherein the apparatus for detecting a fill level includes a first electrode and a second electrode with a dielectric arranged therebetween, the first electrode being formed by the detergent by contact with a conducting conductor applied to the detergent and the second electrode being disposed in the detergent dosing system and configured to be electrically insulated from the first electrode and the fill level is established by evaluating the voltage present between the first electrode and the second electrode.

8. The detergent dosing system according to claim 7 wherein the second electrode is arranged on at least one of an outer wall of the cartridge and on a housing wall of the detergent dispenser.

9. The detergent dosing system according to claim 3 and further comprising an optical waveguide disposed in at least one of the plurality of cartridges wherein a fill level setpoint is set by a height of the optical waveguide.

10. The detergent dosing system according to claim 9 wherein the detergent dosing system is configured for determining the number of cleaning operations that can still be carried out with the detergent contained in the detergent dosing system based on the number of dosing operations carried out since introduction of a new cartridge, and emitting a signal based on the number of cleaning operations that can still be carried out with the detergent contained in the detergent dosing system.

11. The detergent dosing system according to claim 10 wherein the number of cleaning operations can still be carried out with the detergent contained in the detergent dosing system is selected to be between about 1 and about 10, preferably between about 2 and about 5.

12. The detergent dosing system according to claim 1 wherein the apparatus for detecting a fill level in at least one of the detergent dispenser and at least one cartridge is configured for acoustic detection of a fill level.

13. The detergent dosing system according to claim 12 wherein the apparatus for detecting a fill level includes an excitation arrangement for causing the detergent to oscillate, and an evaluation arrangement for evaluating a noise pattern produced by the oscillating detergent.

14. The detergent dosing system according to claim 13 wherein the excitation arrangement includes a piezo ultrasonic generator.

* * * * *